US009551197B2

(12) United States Patent
Greenlee et al.

(10) Patent No.: US 9,551,197 B2
(45) **Date of Patent: *Jan. 24, 2017**

(54) HYDROSTATIC SETTING TOOL

(71) Applicants: Donald R. Greenlee, Murchison, TX (US); Donald Jonathan Greenlee, Murchison, TX (US)

(72) Inventors: Donald R. Greenlee, Murchison, TX (US); Donald Jonathan Greenlee, Murchison, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/842,181

(22) Filed: Sep. 1, 2015

(65) Prior Publication Data

US 2015/0368995 A1 Dec. 24, 2015

Related U.S. Application Data

(63) Continuation of application No. 13/405,758, filed on Feb. 27, 2012, now Pat. No. 9,121,240.

(51) Int. Cl.

| | |
|---|---|
| ***E21B 23/06*** | (2006.01) |
| ***E21B 23/01*** | (2006.01) |
| ***E21B 23/00*** | (2006.01) |
| ***E21B 23/08*** | (2006.01) |

(52) U.S. Cl.

CPC ..... *E21B 23/06* (2013.01); *E21B 23/00* (2013.01); *E21B 23/006* (2013.01); *E21B 23/01* (2013.01); *E21B 23/08* (2013.01)

(58) Field of Classification Search

CPC ..... E21B 23/00; E21B 23/06; E21B 23/006; E21B 23/01; E21B 33/12; E21B 33/1295

See application file for complete search history.

(56) References Cited

U.S. PATENT DOCUMENTS

| | | | | |
|---|---|---|---|---|
| 3,150,718 | A * | 9/1964 | Crowe | E21B 29/00 294/86.17 |
| 4,535,842 | A | 8/1985 | Ross | |
| 4,754,821 | A | 7/1988 | Swietlik | |
| 4,953,617 | A | 9/1990 | Ross | |
| 5,000,026 | A | 3/1991 | Pahnke | |
| 5,103,902 | A | 4/1992 | Ross | |
| 5,375,662 | A | 12/1994 | Echols, III | |
| 6,241,023 | B1 | 6/2001 | Krauss | |
| 2002/0070032 | A1 | 6/2002 | Maguire | |
| 2007/0012461 | A1 | 1/2007 | Morgan | |

(Continued)

OTHER PUBLICATIONS

Product Sheet, "Pressure Setting Assembly", Date of Publication unknown, 1 page.

*Primary Examiner* — Robert E Fuller
*Assistant Examiner* — Christopher Sebesta
(74) *Attorney, Agent, or Firm* — James E. Walton

(57) ABSTRACT

A setting tool for use inside a well bore casing having an upper portion, a lower portion, and a wrap spring. The upper portion includes a mandrel coupled to a connecting line. The upper portion is configured to receive an input. The lower portion includes a first sleeve configured translate along an axis of the setting tool. The lower portion is selectively coupled to the upper portion. The wrap spring has a torsional preload and is coupled to the upper portion and the lower portion. The wrap spring is configured to selectively release the lower portion and upon reception of the input, such that the first sleeve is permitted to translate along the axis.

19 Claims, 11 Drawing Sheets

(56) References Cited

U.S. PATENT DOCUMENTS

| | | | | |
|---|---|---|---|---|
| 2010/0147538 | A1 | 6/2010 | Gaudette | |
| 2010/0155052 | A1 | 6/2010 | Manson | |
| 2010/0175888 | A1* | 7/2010 | Buytaert ..... | E21B 17/00 166/373 |

* cited by examiner

HYDROSTATIC SETTING TOOL

This is a continuation application of U.S. patent application Ser. No. 13/405,758, filed Feb. 27, 2012, titled "Hydrostatic Setting Tool," which is hereby incorporated herein by reference.

BACKGROUND

1. Field of the Invention

The present application relates to setting tools for use in well bores, as well as methods of using such setting tools. In particular, the present application relates to a hydrostatic setting tool.

2. Description of Related Art

Prior downhole tools are known, such as frac plugs and bridge plugs. Such downhole tools are commonly used for sealing a well bore. These types of downhole tools are usually coupled to a setting tool and typically can be lowered into a well bore in an unset position until the downhole tool reaches a desired setting depth. Upon reaching the desired setting depth, the downhole tool is set, or activated, by firing explosive charges or by transmitting electrical signals within the well bore.

Such methods are typically more complex and generally generate more risk. For example, there is a risk that the electrical setting signal could prematurely fire a perforating gun or short out. Additionally, the cost of using explosives can be expensive and hazardous. Likewise, the turn around time required to reset the setting tool for another use is typically lengthened due to the care and precautions dealing with explosives. A safer, more simplified, and cost effective method of setting downhole tools is needed.

Although the foregoing designs represent considerable advancements in the area of setting tools, many shortcomings remain.

DESCRIPTION OF THE DRAWINGS

The novel features believed characteristic of the invention are set forth in the appended claims. However, the invention itself, as well as a preferred mode of use, and further objectives and advantages thereof, will best be understood by reference to the following detailed description when read in conjunction with the accompanying drawings, wherein:

Figure 1:
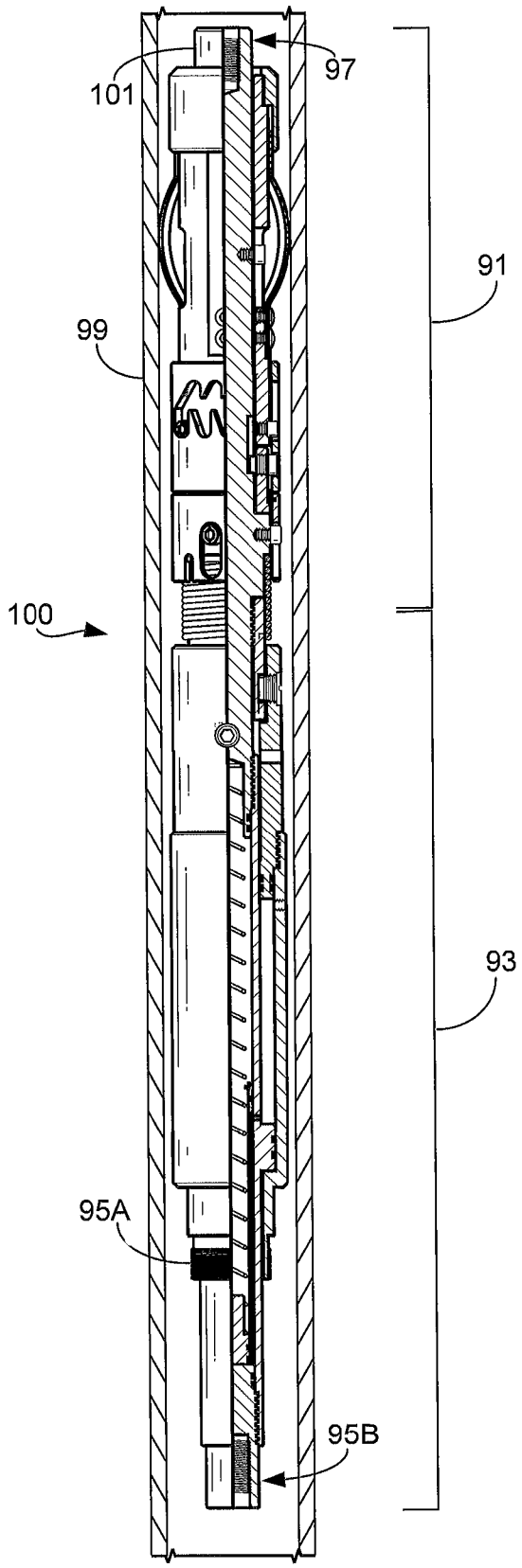
FIG. 1 shows a side view of a setting tool located inside a casing according to the preferred embodiment of the present application.

While the downhole tool of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms such as above, below, upper, and lower to describe a spatial relationship between various components or to describe the spatial orientation of aspects of such components should be understood to describe a relative relationship between the components or a spatial orientation of aspects of such components, respectively, as the device described herein may be oriented in any desired direction.

Referring now to FIG. 1 in the drawings, partially sectioned view of setting tool 100 is illustrated within a casing 99 Setting tool 100 is configured to accept a plurality of devices or tools coupled to an upper threaded portion 97 and/or to a lower threaded portion 95A, 95B. Upper threaded portion 97 may accept a connecting line, for example, a perforating tool and/or a wireline or sandline. Upper threaded portion 97 is integral with a mandrel 101. Lower threaded portion 95A, 95B are configured to couple to a plurality of downhole completion tools, such as a plug or packer, or others operable via a push/pull motion. The push/pull motion generated by setting tool 100 will be described in greater detail below.

Setting tool 100 will be described herein as having an upper portion 91 and a lower portion 93. Due to the interactivity of the various elements of setting tool 100, a clear visual distinction between portions 91, 93 are difficult. However, portions 91, 93 are depicted in FIG. 1 for approximate reference. Upper portion 91 is configured to receive inputs, typically mechanical inputs, from an operator so as to induce relative motion of mandrel 101. The lower portion of setting tool 100 is configured to translate along the axis of setting tool 100, independent of mandrel 101, in response to external forces, so as to generate a push/pull motion for the setting of downhole completion tools. Examples of external forces are hydrostatic pressure and gravity. It is understood that other forces may act upon setting tool 100 and thereby assist in the activation of downhole completion tools.

Setting tool 100 is configured to set the downhole completion tool without the need of explosives or electrical influence within casing 99. As such, the preferred embodiment uses a mechanical input exerted upon mandrel 101 to position and activate setting tool 100.

Setting tool 100 is configured to translate within well bore casing 99. Setting tool 100 may be set at any desired depth within the casing 99. While lowering setting tool 100, fluid is permitted to pass between portions of setting tool 100 and casing 99. A description of the individual portions and parts of setting tool 100 will be described first in FIGS. 2A-2E followed by a more detailed description and illustration of the relative motion of individual portions of setting tool 100 in FIGS. 5-8B.

Figure 2A:
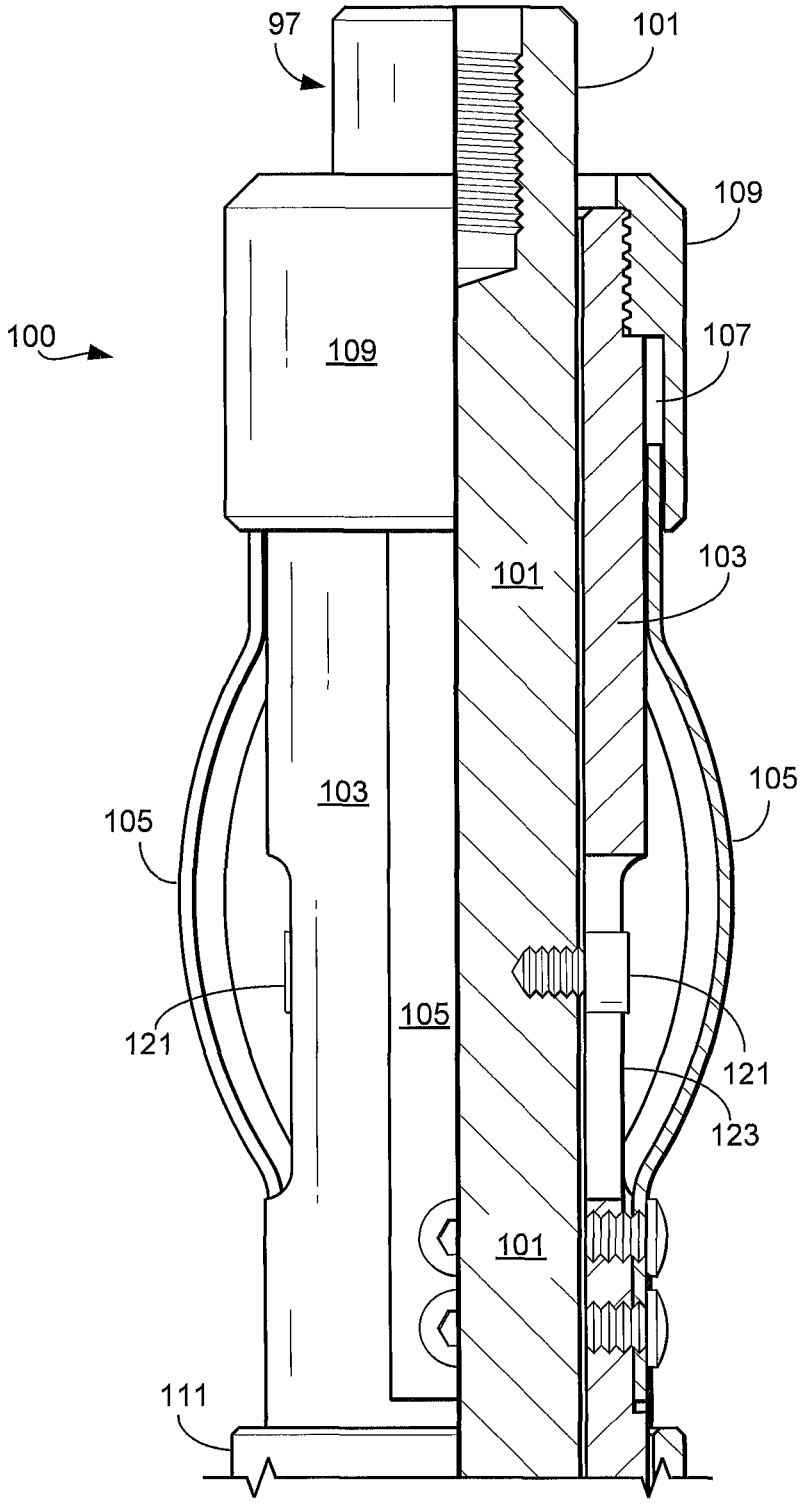
FIGS. 2A-2D are partial sectional views of the setting tool of FIG. 1.
Figure 2B:
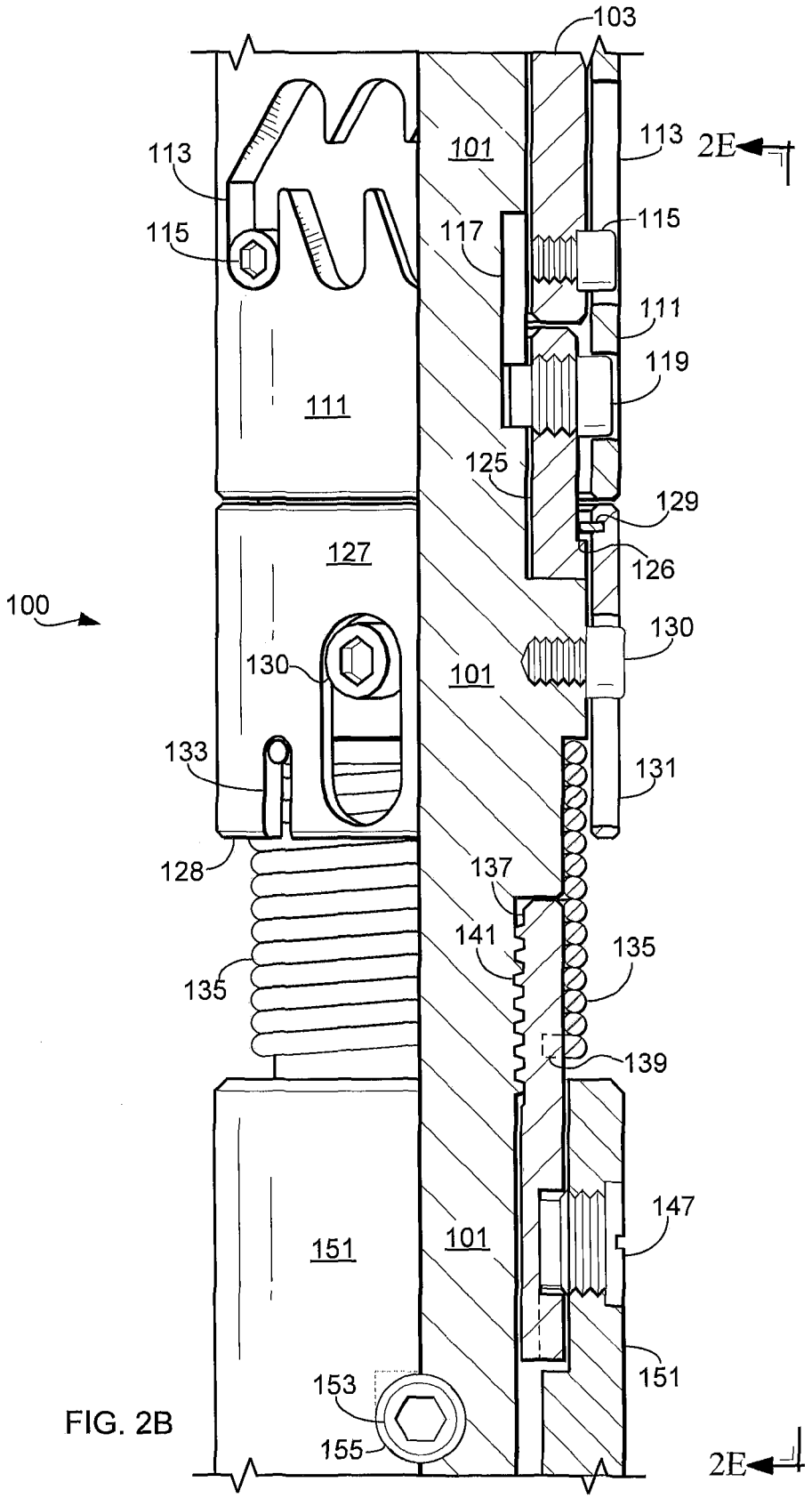
Figure 2C:
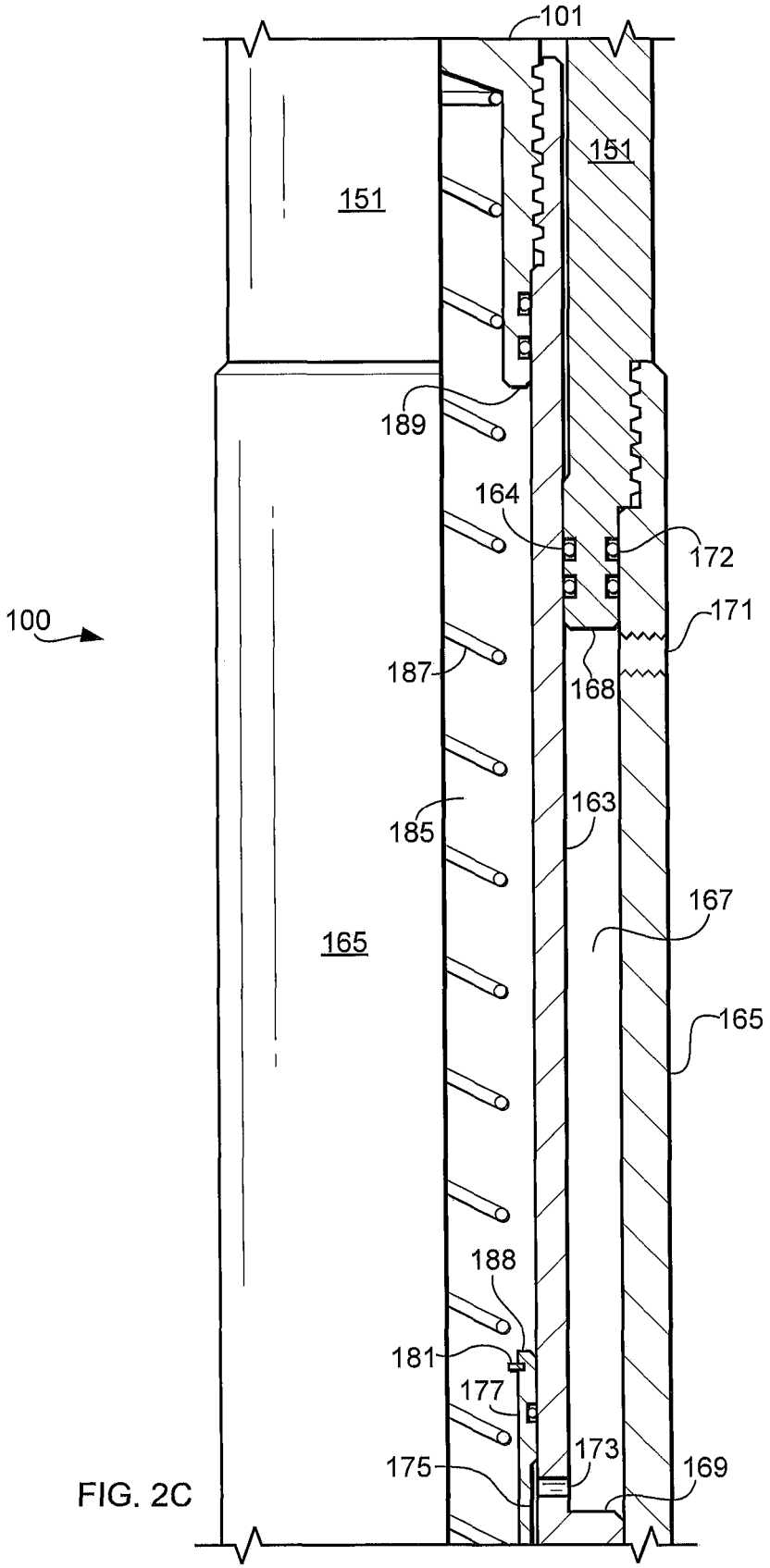
Figure 2D:
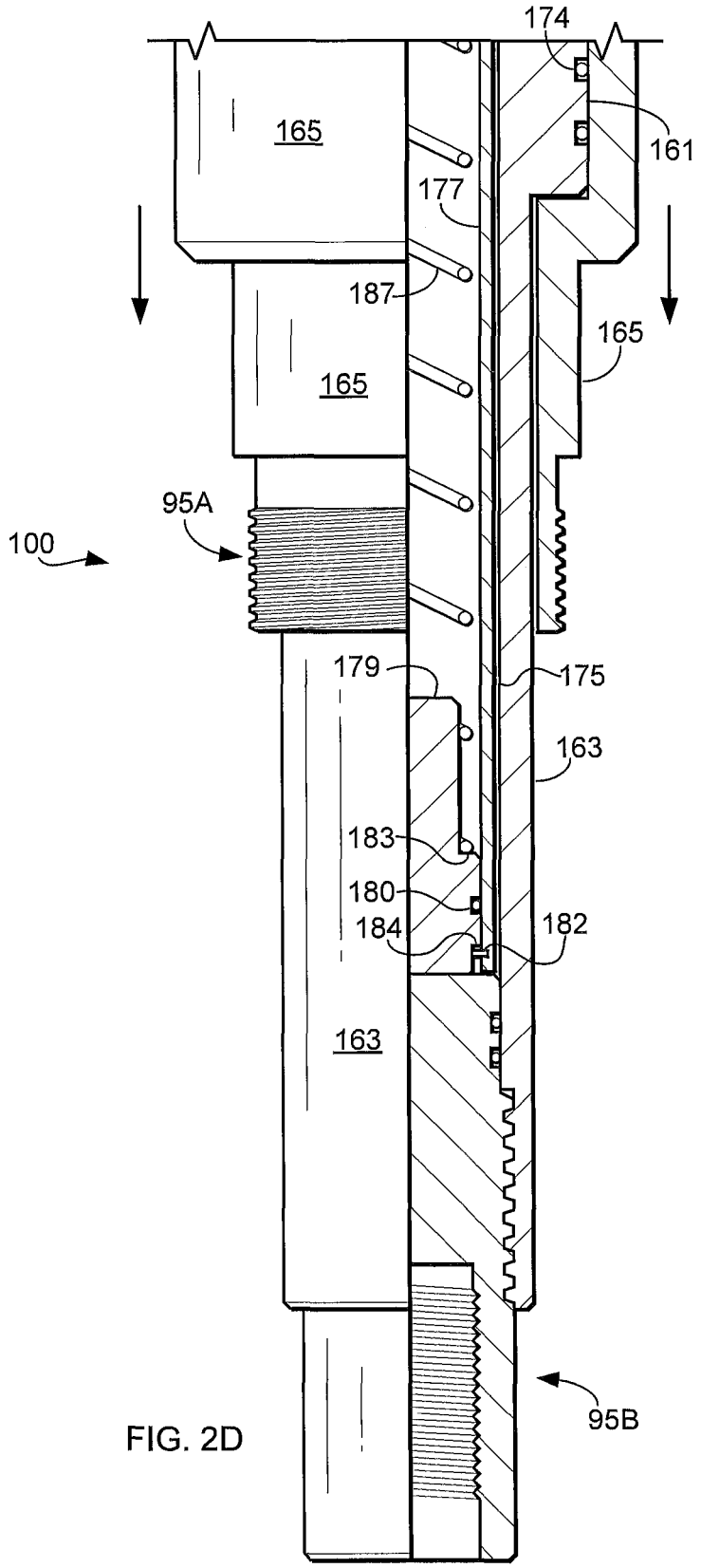

Referring now also to FIGS. 2A-2E in the drawings, independent enlarged views of the individual components found within setting tool 100 are illustrated. FIGS. 2A-2E are illustrated in a static unset state prior to activation of the tool. FIGS. 2A-2E are enlarged partial section views of portions of setting tool 100, as seen in FIG. 1. In combination, FIGS. 2A-2D illustrate the entirety of setting tool 100. The figures are organized, such that FIG. 2A is the upper most portion of setting tool 100 while FIG. 2D is the lower most portion of setting tool 100. The figures illustrate progressively lower portions of setting tool 100 from FIG. 2A through FIG. 2D.

Setting tool 100 includes a mandrel 101 extending approximately half the length of setting tool 100. Mandrel 101 has upper threaded portion 97 configured to accept a variety of other tools or devices for operation within the casing 99 as described previously. A friction spring carrier 103 is disposed around the external surface of mandrel 101 and configured to permit relative motion between mandrel 101 and friction spring carrier 103. A friction spring carrier bolt 121 is threadedly coupled to mandrel 101. The head of friction spring carrier bolt extends within a slot 123 in friction spring carrier 103. The head permits the relative motion between friction spring carrier 103 and mandrel 101 in the axial direction. The head is also configured to prevent radial motion of friction spring carrier 103 around the periphery of mandrel 101.

A plurality of friction springs 105 are coupled to friction spring carrier 103. Friction springs 105 are resilient members that bow outwardly from the outer surface of friction spring carrier 103 and contact an inner surface of casing 99. Friction springs 105 are configured to act as leaf springs to assist in keeping setting tool 100 centered within casing 99. As such, an upper end of each friction spring extends into a respective spring slot 107, which allows room for friction spring 105 to extend and retract as needed. Spring slot 107 is formed by threadedly coupling a friction spring carrier cap 109 to an upper portion of friction spring carrier 103. A lower end of each friction spring 105 is attached to the friction spring carrier 103, for example using bolts or other such mounting hardware. Alternatively, the upper ends of the friction springs 105 can be fixed and the lower ends can be slidable. In the preferred embodiment, at least three friction springs 105 are used. However, it is understood that more or less may be used. Although it is not required, it is understood that the preferred embodiment will equally space friction springs 105 in relation to one another.

Figure 3:
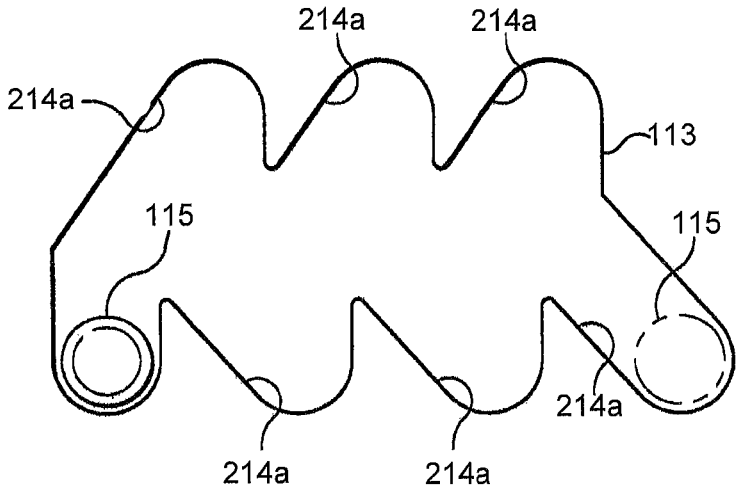
FIG. 3 is a side view of one embodiment of an index slot used in the setting tool of FIG. 1.

An index sleeve 111 is disposed around the external surface of a lower end of friction spring carrier 103. Index sleeve 111 has at least one index slot 113 that extends through the thickness of index sleeve 111. FIG. 3 shows a plan view of one exemplary embodiment of index slot 113. An index pin 115 is threadedly coupled to friction spring carrier 103. The head of index pin 115 is positioned within index slot 113. As seen in FIG. 2B, the initial unset position of index pin 115 within index slot 113 is illustrated. The head of index pin 115 is configured to translate within index slot 113 as relative motion between friction spring carrier 103 and mandrel 101 is generated. In the preferred embodiment, as depicted in FIG. 2B, index sleeve 111 can have two identical index slots 113 with a corresponding number of index pins 115 formed in opposing sides of the index sleeve 111. Other embodiments may utilize one or more index slots 113.

Figure 4:
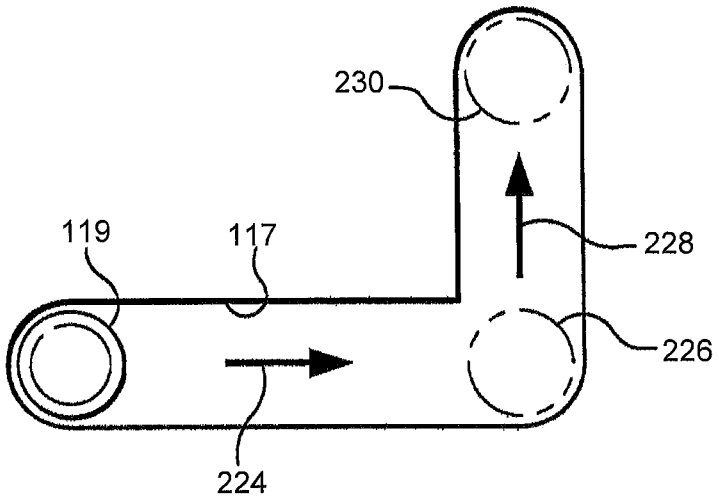
FIG. 4 is a side view of one embodiment of the L-slot used in the setting tool of FIG. 1.

Below friction spring carrier 103 and between index sleeve 111 and mandrel 101 is located a swivel piece 125. Swivel piece 125 is permitted to rotate freely around mandrel 101 as index sleeve 111 rotates. An L-slot pin 119 is threadedly coupled to swivel piece 125. The head of L-slot pin 119 extends externally, in relation to the threaded portion of pin 119, into an aperture within index sleeve 111. As index sleeve 111 rotates, L-slot pin 119 rotates in similar fashion. The lower end of L-slot pin 119 extends internally, in relation to the threaded portion of pin 119, into an L-slot 117 formed within the surface of mandrel 101. The lower end of L-slot pin 119 is not threaded. As index sleeve 111 and swivel piece 125 rotate radially around mandrel 101 the lower end of L-slot pin 119 translates within L-slot 117. At least one L-slot 117 is formed in the outside surface of the mandrel 101. In some embodiments, for example, identical L-slots 117 can be formed in opposing sides of the mandrel 101, thereby allowing for a plurality of L-slots 117 and corresponding L-slot pins 119 to be used. FIG. 4 shows one exemplary embodiment of a plan view of L-slot 117.

A short sleeve 127 is located below index sleeve 111 around a periphery of mandrel 101 and swivel piece 125. Short sleeve 127 includes a retaining clip 129 extending radially around the inside surface of short sleeve 127. Retaining clip 129 is configured to contact a ledge 126 of swivel piece 125 so as to regulate relative motion between swivel piece 125 and short sleeve 127, such that short sleeve 127 remains adjacent index sleeve 111. Short sleeve 127 includes a sleeve bolt 130 threadedly coupled to mandrel 101. The head of sleeve bolt 130 extends externally within a vertical slot 131 located in short sleeve 127. Vertical slot 131 extends through the thickness of short sleeve 127. Vertical slot 131 is configured to permit sleeve bolt 130 and mandrel 101 to translate relative to short sleeve 127 and to restrict radial rotation of short sleeve 127 in relation to mandrel 101. In the preferred embodiment a plurality of sleeve bolts 130 and corresponding vertical slots 131 are used. Two are illustrated in FIG. 2B. However, one or more may be used as desired.

Mandrel 101 is threadedly coupled to a power sleeve 137. Power threads 141 define the type of threads used to couple mandrel 101 and power sleeve 137 together. Power threads 141 are configured to allow power sleeve 137 to rotate in relation to mandrel 101. Power threads are further configured to allow for a reduction in the force required to rotate sleeve 137 in relation to mandrel 101. For example, power threads can generate a 10 to 1 reduction in force. Although power threads 141 are used, it is understood that other types of threaded relationships may also be used. Furthermore, other methods of coupling mandrel 101 and power sleeve 137 are understood to be possible and permit relative rotation with respect to one another.

A wrap spring 135, under a torsional preload, is wound around mandrel 101 and power sleeve 137. An upper portion of wrap spring 135 is located beneath short sleeve 127. The upper portion of wrap spring 135 is releasably secured to short sleeve 127. As illustrated, a spring slot 133 is formed within short sleeve 127 to retain the upper portion of wrap spring 135. Spring slot 133 is defined by three sides, being open along a lower edge 128 of short sleeve 127. A lower portion of wrap spring 135 is secured within an aperture 139 located in power sleeve 137. In the preferred embodiment, mandrel 101 is configured to selectively release the upper portion of wrap spring 135 from short sleeve 127. In the preferred embodiment, the release of wrap spring 135 occurs as mandrel 101 translates with respect to short sleeve 127. Spring slot 133 is configured to permit wrap spring 135 to slide beyond edge 128. Although spring slot 133 has been illustrated as securing wrap spring 135, it is understood that other embodiments may be used to release wrap spring 135 as mandrel 101 translates along the axis of setting tool 100.

Wrap spring 135 operably couples upper portion 91 with lower portion 93 of setting tool 100. Upper portion 91 consists of those elements introduced above. For example, mandrel 101, short sleeve 127, index sleeve 111, friction spring carrier 103, and each of their associated parts are considered within upper portion 91. Upper portion 91 receives inputs and is configured to selectively release the torsional preload in wrap spring 135, thereby permitting power sleeve 137 to rotate. Lower portion 93 includes a connector sleeve 151, a locking pin 147, power sleeve 137, and pistons 161, 179. Lower portion 93 is configured to be selectively released from power sleeve 137 upon the unwinding of wrap spring 135.

Figure 2E:
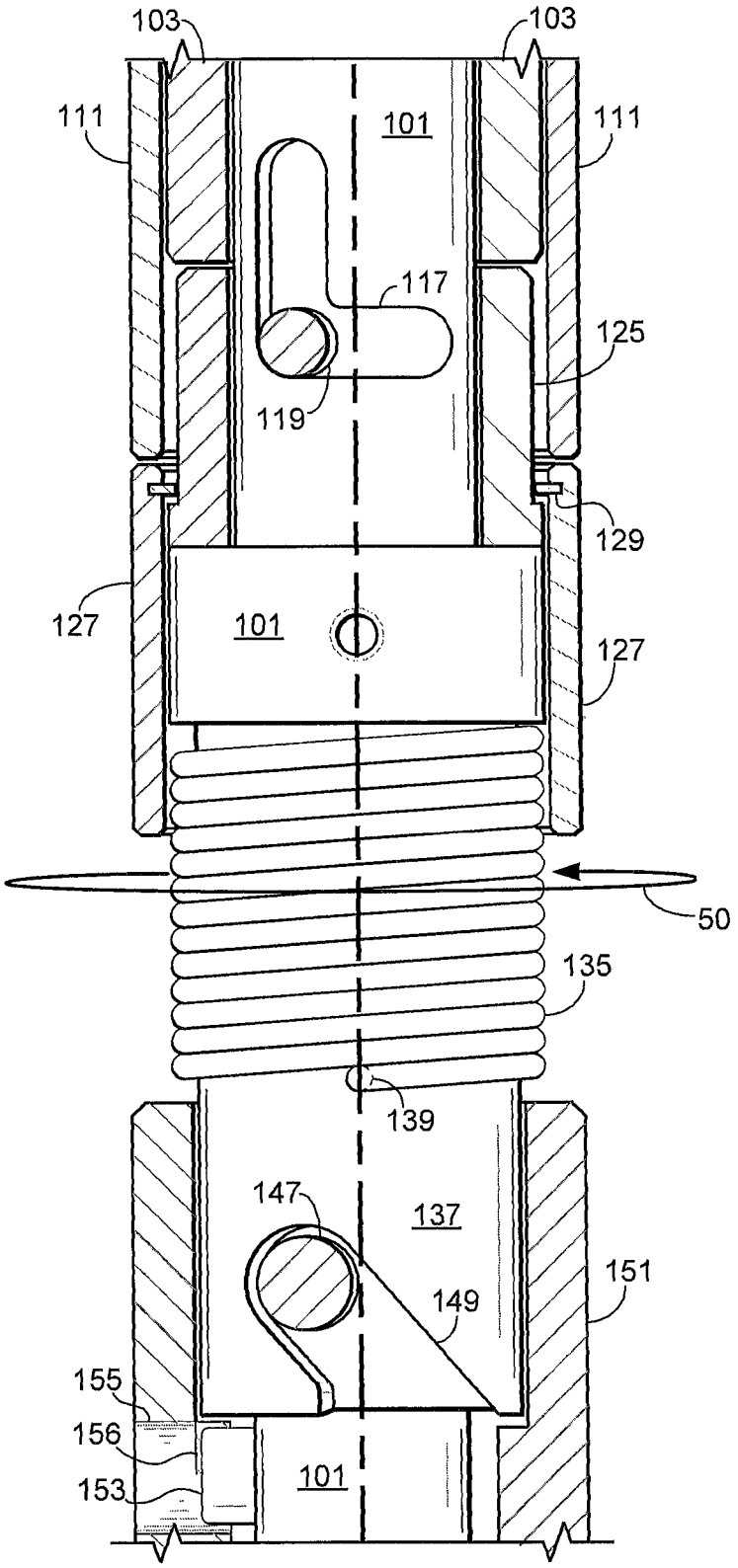
FIG. 2E is a partial sectional view of the setting tool of FIG. 1 having a hook slot and an L-slot.

Connector sleeve 151 extends around a periphery of power sleeve 137 and mandrel 101. Connector sleeve 151 is located below wrap spring 135 and is in active communication with power sleeve 137. Connector sleeve 151 is configured to translate relative to, and independent from, mandrel 101 and power sleeve 137, along the axis of setting tool 100 when wrap spring 135 unwinds. An anti-rotation bolt 153 is configured to permit the translation of connector sleeve 151 along the axis of setting tool 100 but prevent relative rotation between connector sleeve 151 and mandrel 101 while setting tool 100 is in an unset position. Anti-rotation bolt 153 is threadedly coupled to mandrel 101. The head of anti-rotation bolt 153 protrudes into a portion of an aperture 155 that extends through connector sleeve 151. In the preferred embodiment, the shape of aperture 155 adjacent the exterior surface of connector sleeve 151 is circular; while the shape of aperture 155 adjacent the interior surface of connector sleeve 151 is U-shaped. The differences in shape within aperture 155 occur along edge 156, as seen in FIG. 2E. The U-shaped portion of aperture 155 wraps around both sides and beneath anti-rotation bolt 153. Connector sleeve 151 is permitted to pass over anti-rotation bolt 153 while translating along the axis. It is understood that other shapes and methods may be used to permit the translation of connector sleeve 151 along the axis while restricting radial rotation relative to mandrel 101.

Connector sleeve 151 is held in an unset position by a locking pin 147. Locking pin 147 is threadedly coupled to connector sleeve 151. A lower portion of locking pin 147 extends internally within a hook slot 149 formed within an exterior surface of power sleeve 137. Prior to activation of setting tool 100, wrap spring 135 is wound having a torsional preload configured to apply a torque or rotational force on power sleeve 137, so as to rotate power sleeve 137 relative to mandrel 101 in the direction indicated by arrow 50. This torque creates a binding force between the combinations of power sleeve 137 and locking pin 147 with that of anti-rotation bolt 153 and connecting sleeve 151. This binding force prevents the unwinding of power sleeve 137 as well as the translation of connector sleeve 151 until wrap spring 135 is released from upper portion 91. Power sleeve 137 is configured to selectively rotate around mandrel 101 and selectively permit the translation of connector sleeve 151 along the axis of setting tool 100.

External forces acting upon connector sleeve 151 and lower portion 93 may be relatively large. For example, such forces may approach 30,000 pounds. Hook slot 149 is oriented at an angle relative to the axis of setting tool 100 such that the external forces are divided into a combination of resultant forces. The orientation of hook slot 149, together with power threads 141 reduces the forces required to secure locking pin 147 within hook slot 149. For example, hook slot 149 may result in a 30 percent reduction of force required to maintain the binding force. Therefore the torsional preload on wrap spring 135 is reduced in order to retain locking pin 147 within hook slot 149. For example, the torsional preload may be reduced to 5 or 10 pounds.

When wrap spring 135 is released from short sleeve 127, wrap spring 135 unwinds thereby releasing the binding force on power sleeve 137 and locking pin 147. Power sleeve 137 is thereby permitted to rotate around mandrel 101. Axial external forces exerted upon connector sleeve 151 rotate power sleeve 137, such that locking pin 147 is removed from hook slot 149 and connector sleeve 151 is permitted to translate in a downward direction along the axis of setting tool 100.

Referring now particularly to FIGS. 2C and 2D in the drawings. The lower portion of setting tool 100 includes the parts, elements, ports, channels, and other devices used to facilitate the relative translation of a plurality of pistons. In this embodiment, two pistons are used within setting tool 100.

An outer piston 161 is integrally formed within an inner piston sleeve 163. Inner piston sleeve 163 is a cylindrical sleeve relatively concentric to the axis that is threadedly coupled to mandrel 101 at an upper end and is threadedly coupled to lower threaded portion 95B at a lower end. Because inner piston sleeve 163 is coupled to mandrel 101, inner piston sleeve is prevented from translating along the axis independent of mandrel 101. In this configuration, when wrap spring 135 is released from short sleeve 127, connector sleeve 151 translates along the axis in the direction of the arrows shown, but inner piston sleeve 163 does not translate. Although inner piston sleeve 163 has been described as being coupled to mandrel 101 without the ability to translate, other embodiments may permit translation of inner piston sleeve 163 by using slots and pins, for example.

Connector sleeve 151 extends around a periphery of inner piston sleeve 163. Connector sleeve 151 is configured to sealingly engage the exterior surface of inner piston sleeve 163 with one or more inner seals 164 coupled to connector sleeve 151. An outer piston sleeve 165 is threadedly coupled to a lower portion of connector sleeve 151 and extends around a periphery of connector sleeve 151 and inner piston sleeve 163, such that an outer chamber 167 is formed. Outer chamber 167 is a volume extending radially around setting tool 100 defined by the interior surface of outer piston sleeve 165 and the exterior surface of inner piston sleeve 163 as well as a lower face 168 of connector sleeve 151 and an upper face 169 of piston 161.

Outer chamber 167 is configured to retain a variety of fluids. In the preferred embodiment, the type of fluids held in outer chamber 167 are relatively incompressible fluids, such as oil. Fluids enter into outer chamber 167 through a fill hole 171 penetrating through outer piston sleeve 165. Although not shown, a bolt is releasably threaded into fill hole 171 to permit filling, draining, and to avoid the leaking of fluid. One or more outer seals 172 prevent the leakage of fluid between outer piston sleeve 165 and connector sleeve 151. One or more seals 174 prevent the leakage of fluid between outer piston sleeve 165 and piston 161. The use of seals 164, 172, and 174 extend around setting tool 100 and seal outer chamber 167.

Connector sleeve 151 and outer piston sleeve 165 are configured to translate as one body in the direction of the arrows shown in FIGS. 2C and 2D. Such translation shortens the distance between lower face 168 and upper face 169. A metering port 173 is located in, and penetrates through, inner piston sleeve 163. Metering port 173 is configured to permit fluid to exit outer chamber 167 and extend down a metering channel 175 during translation. Metering port 173 is configured to regulate the flow rate of the fluid exiting outer chamber 167, such that the speed of translation of connector sleeve 151 and outer piston sleeve 165 is controlled.

Metering channel 175 is a volume extending around the periphery of a telescoping sleeve 177 and within the interior surface of inner piston sleeve 163. Telescoping sleeve 177 sealingly engages the inner surface of inner piston sleeve 163 above metering port 173 and extends lower relatively concentric to the axis adjacent lower threaded portion 95B. The lower end of metering channel 175 is sealed off by lower threaded portion 95B. Telescoping sleeve 177 is configured to permit the flow of fluid from outer chamber 167, through metering port 173, and between telescoping sleeve 177 and lower threaded portion 95B, such that fluid pressure acts upon an inner piston 179 and telescoping sleeve 177 to result in the translation of inner piston 179 and telescoping sleeve 177 in a direction opposite that of outer piston sleeve 165 and connector sleeve 151. The combination of telescoping sleeve 177 and inner piston 179 will be referred to as a telescoping piston.

Telescoping sleeve 177 and inner piston 179 are configured to translate along the axis independent of one another. Inner piston 179 slidingly engages the interior surface of telescoping sleeve 177. A seal 180 extends around inner piston 179 and prevents fluid from passing between telescoping sleeve 177 and inner piston 179. Telescoping sleeve 177 has an upper retaining clip 181 and a lower retaining clip 182. Retaining clips 181, 182 are configured to limit the translation of inner piston 179 independent from the translation of telescoping sleeve 177. Inner piston 179 has an upper flange 183 and a lower flange 184 extending around the circumference of inner piston 179. Flanges 183, 184 are configured to contact retaining clips 181, 182 respectively.

An inner chamber 185 is formed within setting tool 100. Inner chamber 185 is a volume defined as the space within the inner surface of inner piston sleeve 165, the lower end of mandrel 101 and the interior surfaces of the telescoping piston. Inner chamber 185 is filled with a compressible fluid, such as air for example. A spring 187 is located within inner chamber 185 and is biased against the lower end of mandrel 101 and upper flange 183. As the telescoping piston is translates, spring 187 and the fluid within inner chamber 185 is compressed within inner chamber 185. Telescoping piston is permitted to translate such that a face 188 of telescoping sleeve 177 contacts a mandrel face 189. Spring 187 is configured to exert a force upon the telescoping piston so as to return the telescoping piston adjacent to lower threaded portion 95B as the external forces are removed.

In order to illustrate how the various parts within setting tool 100 interact and move, a frame of reference is to be defined. Friction springs 105 press against casing 99, thereby exerting a certain amount of force, or resistance to motion. For illustrative purposes, friction springs 105 and the associated parts will be considered static while mandrel 101 and the associated parts will be considered dynamic.

Referring now also to FIGS. 3-8B in the drawings, setting tool 100 is illustrated in an activated position. While lowering setting tool 100 and prior to activation, an upward force is applied to upper threaded portion 97 via a connecting line (not shown) in opposition to the external forces. This upward force enables mandrel 101 to remain in an elevated position as compared to that of friction spring carrier cap 109, as seen in FIG. 2A. Once setting tool 100 is positioned at the desired depth, activation of setting tool 100 begins by applying a jolting force to mandrel 101. This jolting force is generated by providing a sudden release of upward forces through the connecting line followed by a corresponding application of upward force.

Referring now particularly to FIG. 3 in the drawings. The repeated application of the jolting force moves index pin 115 through the portions of index slot 113. FIG. 3 is representative example of index slot 113 in a multi-action index sleeve wherein multiple repetitions of the jolting force is required as opposed to a single action index sleeve requiring the application of a single jolting force. It is understood that other types of index slot 113 may be equally applicable for use herein. As the jolting force is applied, index pin 115 is raised and lowered in index slot 113. Index slot 113 includes a plurality of contact surfaces 214*a* that extend at a non-zero angle relative to the upward and downward travel directions of index pin 115. Each time the jolting force is applied, index pin 115 urges against a subsequent contact surface 214*a*. The angle of the contact surface 214*a* is such that index sleeve 111 is caused to rotate as index pin 115 is raised or lowered in index slot 113. In the embodiment shown in FIG. 3, index pin 115 is shown in solid lines in the unset position (while setting tool is lowered within casing 99) and in broken lines in the set position (when wrap spring 135 is released). In this embodiment, the setting tool 100 can be jolted three times before wrap spring 135 will be released. In alternative embodiments, index slot 113 can include more or fewer contact surfaces 214*a*, thus requiring more or fewer times that the setting tool 100 can be jolted prior to setting the downhole completion tool.

An advantage of a multi-action index sleeve is the ability to avoid presetting of setting tool 100 while lowering within casing 99. Furthermore, multi-action index sleeves 111 provide a greater degree of safety in that they rely on repetitive mechanical inputs to operate.

Referring now particularly to FIG. 4 in the drawings. As the jolting force is applied to setting tool 100, index sleeve 111 rotates about the mandrel 101. L-slot pin 119 is attached to index sleeve 111, so that as index sleeve 111 rotates, L-slot pin 119 travels along L-slot 117 in the direction indicated by arrow 224. Once the jolting force has be applied the requisite number of times to setting tool 100, index sleeve 111 will be rotated to a position where L-slot pin 119 is located at position 226 in FIG. 4. From position 226, L-slot pin 119 is free to travel in an upwards direction by arrow 228 from position 226 to position 230. Since L-slot pin 119 is fixed relative to index sleeve 111, this means that mandrel 101 is now permitted to move an additional distance along the axis in relation to that of pin 119 and index sleeve 111. Although L-slot 117 is illustrated with a selected orientation, it is understood that L-slot 117 may be oriented in a plurality of directions so as to coordinate the movements of index sleeve 111 and L-slot pin 119 within L-slot 117.

Figure 5:
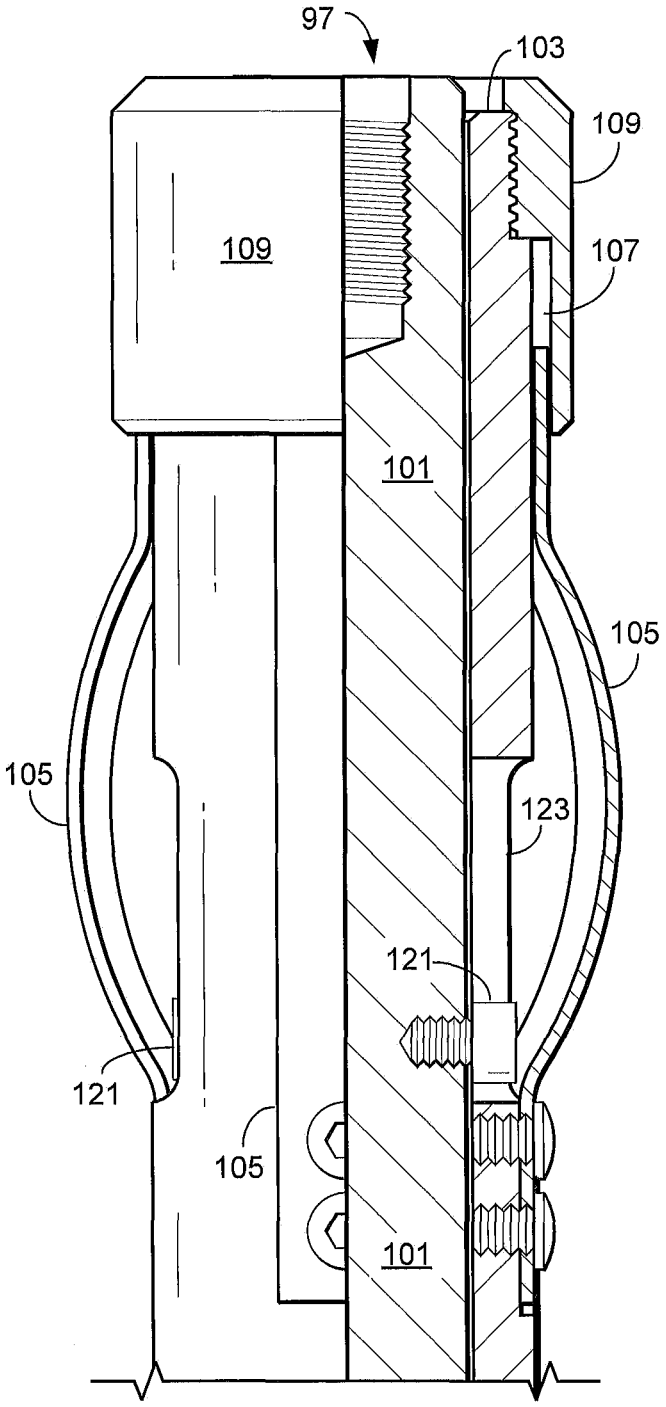
FIGS. 5-8B are partial sectional views of the setting tool of FIG. 1 during operation.

Referring now particularly to FIG. 5 in the drawings, mandrel 101 is positioned such that friction spring carrier cap 109 and mandrel 101 form a common planar surface. Friction springs 105, friction spring carrier 103, and friction spring carrier cap 109 are coupled together and are in a static state as the jolting force is applied to mandrel 101. As mandrel 101 is lowered, bolt 121 translates within slot 123. Slot 123 is configured to surround the sides of bolt 121 to prevent rotation of friction spring carrier 103 to that of mandrel 101.

Figure 6:
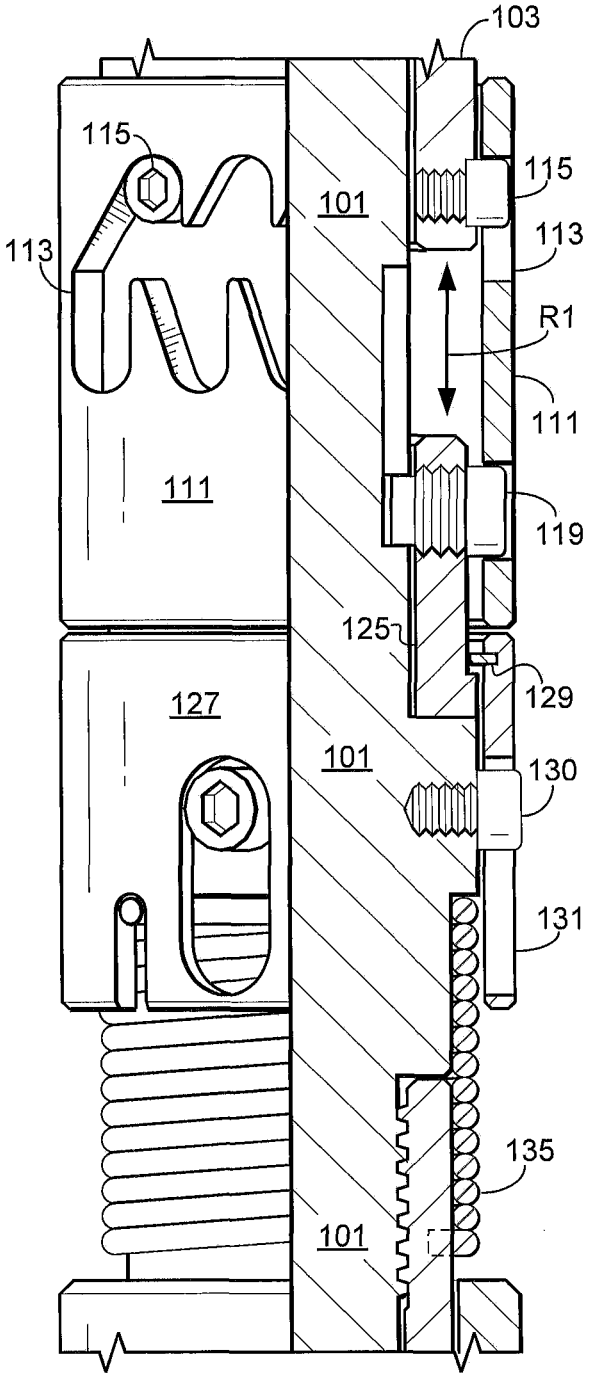

Referring now particularly to FIG. 6 in the drawings, the location of upper portion 91 is illustrated when mandrel 101 is lowered as seen in FIG. 5. As stated above, as mandrel 101 is raised and lowered, index sleeve 111 rotates around mandrel 101 due to index pin 115 making contact with contacting surfaces 214*a* of index slot 113. L-slot pin 119 and swivel piece 125 rotate with index sleeve 111. Short sleeve 127 and index sleeve 111 move in conjunction with mandrel 101 at this stage of activation. When mandrel 101 is lowered, a space is created between friction spring carrier 103 and swivel piece 125 as denoted by arrow R1. As mandrel 101 is raised, the distance denoted by arrow R1 is removed. Ledge 126 of swivel piece 125 is configured to contact retaining clip 129 and also raise short sleeve 127. Prior to index pin 115 being positioned denoted by broken lines in FIG. 3, the only relative motion that occurs during application of the jolting force is the separation denoted by arrow R1, the rotation of index sleeve 111, and the rotation of L-slot pin 119 within L-slot 117. During this time, wrap spring 135 remains secured by short sleeve 127. Lower portion 93 moves in conjunction with mandrel 101.

Figure 7:
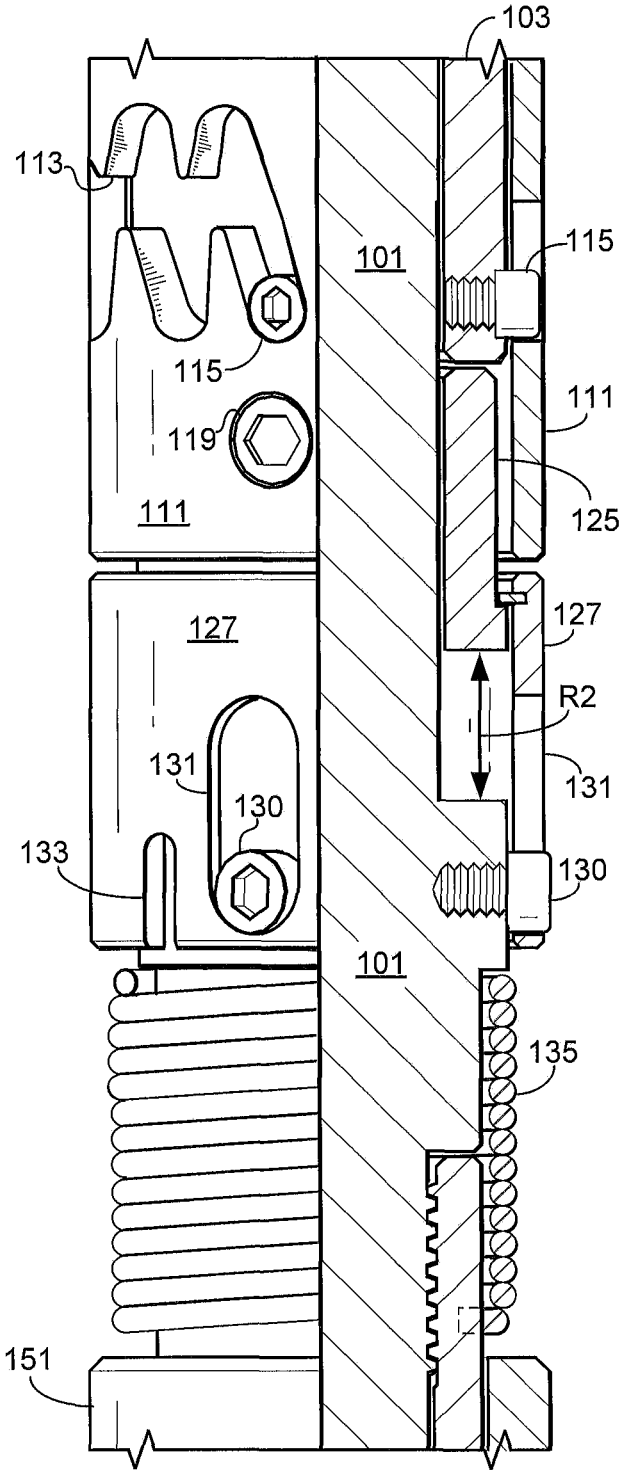

Referring now particularly to FIG. 7 in the drawings, index pin 115 is positioned as depicted by broken lines in FIG. 3. For index pin 115 to be in such a position, an upward force has to be applied to mandrel 101, so as to raise index sleeve 111. The upward force closes the distance denoted by arrow R1. However, L-slot pin 119 has rotated and is now in position 226 as seen in FIG. 4. To be in position 230, a subsequent lowering of mandrel 101 will permit a separation between swivel piece 125 and mandrel 101 as denoted by arrow R2. The space denoted by arrow R1 in FIG. 6 is removed for illustrative purposes.

Upon the subsequent lowering of mandrel 101, mandrel 101 is configured to translate an additional amount along the axis independent of index sleeve 111, swivel piece 125 and short sleeve 127. Upon the subsequent lowering of mandrel 101, index sleeve 111 and swivel piece 125 remain fixed in relation to L-slot pin 119. Retaining clip 129 contacts ledge 126, thereby preventing short sleeve 127 from separating from index sleeve 111. Therefore, mandrel 101 and sleeve bolt 130 continue along the axis. This extra translation permits wrap spring 135 to release from short sleeve 127 and in particular, spring slot 133. Wrap spring 135 now releases the torsional preload and permits power sleeve 137 to rotate freely.

Figure 8A:
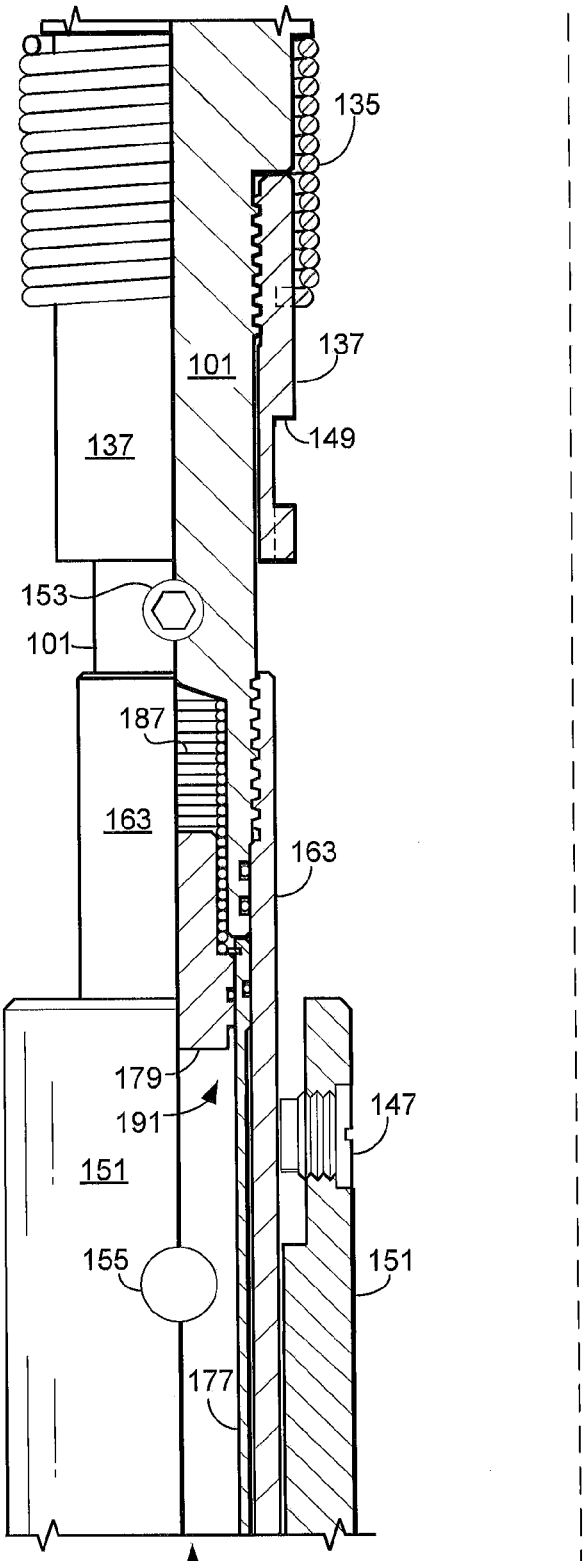
Figure 8B:
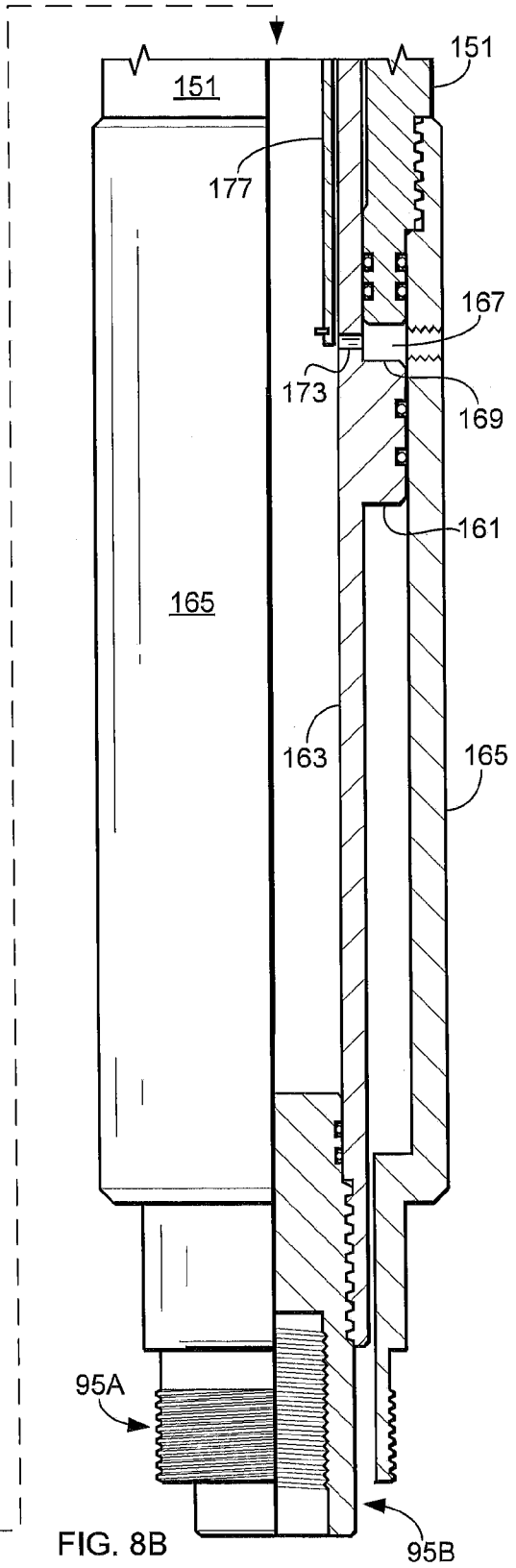

Referring now particularly to FIGS. 8A and 8B in the drawings, lower portion 93 is illustrated in an activated position. Connector sleeve 151 and outer piston sleeve 165 have translated along the axis of setting tool 100 such that lower portions 95A, 95B are adjacent one another. The incompressible fluid in outer chamber 167 has traveled through metering port 173, thereby compressing spring 187 and the compressible fluid in inner chamber 185. Telescoping piston 191 is seen in a fully extended position. Fluid within casing 99 traveled between lower threaded portion 95A on outer piston sleeve 165 and inner piston sleeve 163.

The present application provides significant advantages, including: (1) the ability to set a downhole completion tool without the use of explosives or electricity in the casing; (2) reduction in force required to secure lower portion 93; (3) ability to avoid premature setting of the downhole tool; (4) decreased costs associated with firing explosives; (5) decreased maintenance associated with explosives and electrical wiring; (6) increased success rate due to mechanical nature of the setting tool; and (7) mechanical nature of the setting tool allows for quicker resetting of the tool in preparation for the lowering of another downhole completion tool.

The method of operating setting tool 100 requires a number of steps. Upper portion 91 and lower portion 93 are arranged in an unset position. Wrap spring 135 is preloaded with a torque configured to rotate power sleeve 137 such that hook slot 149 applies a binding force on locking pin 147. A downhole completion tool is coupled to lower threaded portions 95A, 95B while a connecting line is coupled to upper threaded portion 97. Setting tool 100 is aligned with casing 99 and lowered by the connecting line to a desired depth. Once the depth is reached, tension is released from the connecting line resulting in mandrel 101 responding to external forces and translating further down casing 99. This motion causes index pin 115 to translate within index slot 113 thereby rotating index sleeve 111 around mandrel 101. A force is applied to mandrel 101 through connecting line moving mandrel 101 back up a distance within casing 99. This repeated force is the jolting forces discussed above. The jolting force incorporates the releasing and subsequent application of force on connecting line. Once sufficient jolting forces have been applied, setting tool 100 is activated and the downhole completion tool is set. Setting tool 100 may then be removed from casing 99 and prepared for additional work within casing 99.

While the preferred embodiment has been described with reference to an illustrative embodiment, this description is not intended to be construed in a limiting sense. Various modifications and other embodiments of the invention will be apparent to persons skilled in the art upon reference to the description.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A setting tool for use in a well bore casing, comprising:

a mandrel configured to receive an input, so as to induce relative motion of the mandrel within the casing;

a first sleeve configured to translate along an axis of the setting tool;

a power sleeve threadedly connected to the mandrel; and a wrap spring extending about the mandrel and into an aperture in the power sleeve, the wrap spring being configured to accept a torsional preload to secure the first sleeve by preventing the power sleeve from rotating relative to the mandrel, the wrap spring being configured to selectively release the first sleeve upon reception of the input.

2. The setting tool of claim 1, wherein translation of the first sleeve is generated in response to external forces.

3. The setting tool of claim 1, wherein the torsional preload is a rotational force applied through the wrap spring to restrict relative motion between the first sleeve and the mandrel.

4. The setting tool of claim 1, further comprising:
an index sleeve surrounding the mandrel;
an index slot extending through the index sleeve; and
an index pin configured to translate within the index slot in response to the input;
wherein the index sleeve is configured to rotate around the mandrel as the index pin translates within the index slot.

5. The setting tool of claim 4, further comprising:
a swivel piece extending around a periphery of the mandrel and configured to rotate in relation to the mandrel; and
an L-slot pin coupled to the swivel piece and configured to rotate with the index sleeve within an L-slot, the L-slot pin configured to selectively restrict movement of the mandrel along the axis.

6. The setting tool of claim 1, further comprising:
a short sleeve extending around a periphery of the mandrel, the short sleeve configured to selectively secure the wrap spring, so as to maintain the torsional preload.

7. The setting tool of claim 6, wherein the short sleeve is configured to release the torsional preload in the wrap spring, such that the wrap spring unwinds.

8. The setting tool of claim 1, wherein the input is an intermittent axial force exerted upon the mandrel.

9. The setting tool of claim 1, further comprising a lower threaded portion for the coupling of a downhole completion tool.

10. The setting tool of claim 1, wherein translation of the first sleeve is regulated by the movement of fluid within the setting tool.

11. The setting tool of claim 1, further comprising:
an inner piston sleeve threadedly connected to the mandrel, the inner piston sleeve at that at least partially defining a first fluid chamber configured to selectively store an incompressible fluid; and
a metering port extending through the inner piston sleeve and in fluid communication with the first fluid chamber, the metering port being configured to regulate the flow of fluid from the first fluid chamber.

12. The setting tool of claim 11, further comprising:
a telescoping piston configured to translate along the axis in response to pressure from the incompressible fluid exiting through the metering port.

13. The setting tool of claim 12, further comprising:
a second fluid chamber in communication with the telescoping piston and being configured to retain a compressible fluid, the telescoping piston separating the compressible fluid from the incompressible fluid; and
wherein the second fluid chamber is configured to bias the telescoping piston against the incompressible fluid.

14. A method of operating a setting tool, the method comprising:
threading a power sleeve onto a mandrel;
applying a torsional preload to a wrap spring that extends about the mandrel and into an aperture in the power sleeve, the wrap spring being configured to selectively retain the relative position of the power sleeve by preventing the power sleeve from rotating relative to the mandrel;
attaching a connecting line to the upper portion;
lowering the setting tool within a casing sufficient to obtain a desired depth; and
applying an input through the connecting line to the setting tool, so as to activate the setting tool.

15. The method of claim 14, further comprising:
coupling a downhole completion tool to a lower portion of the setting tool.

16. The method of claim 14, wherein the input is a mechanical input exerted upon the mandrel through a systematic release and application of force to the connecting line.

17. The method of claim 14, wherein activation of the setting tool occurs when a sufficient quantity of inputs have been received by the setting tool, so as to release the wrap spring from a short sleeve that extends around the mandrel.

18. The method of claim 17, further comprising:
selectively releasing the wrap spring from the short sleeve;
wherein a lower portion of the setting tool translates in response to external forces.

19. The method of claim 14, further comprising:
removing the setting tool from the casing.

* * * * *